US011641967B2

(12) United States Patent
Shelton

(10) Patent No.: US 11,641,967 B2
(45) Date of Patent: May 9, 2023

(54) SELF-SERVE COMMUNION CONTAINMENT, PRESENTATION AND SERVICE DEVICE

(71) Applicant: Gary Shelton, Chaska, MN (US)

(72) Inventor: Gary Shelton, Chaska, MN (US)

( * ) Notice: Subject to any disclaimer, the term of this patent is extended or adjusted under 35 U.S.C. 154(b) by 0 days.

(21) Appl. No.: 17/342,052

(22) Filed: Jun. 8, 2021

(65) Prior Publication Data

US 2022/0386799 A1 Dec. 8, 2022

(51) Int. Cl.
*A47G 33/00* (2006.01)

(52) U.S. Cl.
CPC ..... *A47G 33/002* (2013.01)

(58) Field of Classification Search
CPC ..... A47B 37/00; A47G 19/08; A47G 23/06; A47G 23/0641; A47G 33/002; A47L 15/505
USPC ..... 206/19, 139–203; 211/41.18, 74, 76
See application file for complete search history.

(56) References Cited

U.S. PATENT DOCUMENTS 553,846 A * 2/1896 Forbes ..... A47G 19/08 206/167
678,699 A 7/1901 Thomas
1,156,319 A * 10/1915 Schaub ..... A47B 73/00 211/74
1,199,987 A 10/1916 Husted
1,539,363 A * 5/1925 Maddock ..... A47B 37/00 211/76
D138,433 S 8/1944 Lindblad
2,851,154 A * 9/1958 Dingeldein ..... A47G 33/00 206/562
2,853,349 A 9/1958 Wilcox
3,261,494 A 7/1966 Walker, Jr.
3,514,029 A 5/1970 Powell
D279,865 S 7/1985 McKee
5,246,106 A 9/1993 Johnson
5,271,496 A 12/1993 Cain
5,456,351 A 10/1995 Johnson
6,022,570 A 2/2000 Richmond
D423,754 S 4/2000 Kim
6,135,296 A 10/2000 Colgrove
(Continued)

FOREIGN PATENT DOCUMENTS

WO 9319653 A1 10/1993

*Primary Examiner* — Bryon P Gehman
(74) *Attorney, Agent, or Firm* — Christensen, Fonder, Dardi & Herbert PLLC; John Fonder

(57) ABSTRACT

A self-serve, communion containment, presentation and service device for presenting individual servings of a host and cup of wine that are kept isolated and covered until such a time that they are presented for consumption. The device includes a first end, second end, front side, rear side, top side and bottom side. The device comprises a frame; a platform attached to the frame, the platform including a top surface and defining through slots to receive communion hosts and apertures to receive a wine cup; and hinged covers covering the slots and the apertures, each hinged cover configured to cover only one slot and one aperture when the hinged cover is in a closed position. Each individual serving of one host and one cup of wine is positioned under one of the caps and held stationary in a single respective slot and a single respective aperture, until removed by the communicant.

17 Claims, 5 Drawing Sheets

(56) References Cited

U.S. PATENT DOCUMENTS

| | | | | |
|---|---|---|---|---|
| 8,193,918 | B1 * | 6/2012 | Shavelsky | A61J 7/04 700/242 |
| 8,253,561 | B2 | 8/2012 | Bowers | |
| D666,785 | S | 9/2012 | Klingner | |
| 8,744,620 | B2 * | 6/2014 | Shavelsky | A61J 7/04 700/242 |
| 9,289,354 | B2 | 3/2016 | Ryan | |
| 2013/0030566 | A1 | 1/2013 | Shavelsky | |
| 2015/0122673 | A1 | 5/2015 | Loumbroukos | |

* cited by examiner

SELF-SERVE COMMUNION CONTAINMENT, PRESENTATION AND SERVICE DEVICE

FIELD OF THE DISCLOSURE

The present disclosure is generally directed to service of communion for religious ceremonies. More specifically, the present disclosure is directed to devices, systems and methods for making multiple, individual servings of communion hosts and wine available for a recipient to easily and sanitarily pick up and consume.

BACKGROUND OF THE INVENTION

Traditionally, the Christian rite of Holy Communion is administered by a religious clergyman or Eucharistic minister handling and offering bread, in the form of a "host," and wine, symbolizing the body and blood of Jesus Christ, to recipients or "communicants" for consumption. An individual serving of the bread, often in the form of a small, thin wafer or disk, is picked up from a group of multiple hosts held in a common container, by the Eucharistic minister and placed in the mouth or hand of the communicant (receiver of the host). Similarly, a Eucharistic minister may offer wine to a communicant by handing them a cup of wine to drink from. The cup may be a relatively large cup or chalice from which multiple communicants drink, or may be a smaller, single-serving, perhaps disposable, cup.

Such traditional practices risk the spread of communicable diseases amongst communicants, clergy and Eucharistic ministers. For example, viruses or bacteria may pass from the Eucharistic minister to the communicant, or vice versa, through direct human contact, or indirectly through the common container or cup containing the hosts and wine.

Some known inventions attempt to address this risk. For example, racks or trays for holding small open cups of individual servings of wine are known. One such example is U.S. Pat. No. 553,846 to Forbes ("Forbes") which discloses a rack system with multiple circular openings for receiving small reusable wine cups.

Various devices for holding an individual serving of a host and a small amount of wine are known. Such devices comprise a liquid-containing portion for the wine, and a host-containing portion for the host, with the host typically located on top of the liquid-containing portion. Such devices may be entirely disposable, and may comprise a single sealed unit. Two such examples are U.S. Pat. No. 3,514,029 to Powell and U.S. Pat. No. 5,246,106 to Johnson However, such known devices and systems are deficient in a number of ways, for the reasons described further herein.

SUMMARY

In an embodiment, the invention is a self-serve, communion containment, presentation and serving device. The device includes a first end, second end, front side, rear side, top side and bottom side. The device also includes a frame and a platform attached to the frame, the platform including a top surface and defining a plurality of through openings or holes, such as slots, configured to receive communion hosts. The device also includes a plurality of hinged covers covering the plurality of slots, each hinged cover of the plurality of hinged covers configured to cover only one slot of the plurality of slots when the hinged cover is in a closed position.

In an embodiment, the through slots of the self-serve, communion containment, presentation and serving device may be sized and angled so that communion hosts are easily viewed and grasped by someone accepting communion.

In another embodiment, the platform of the self-serve, communion containment, presentation and serving device may define apertures configured to receive a communion cup. In one such embodiment, one aperture is positioned adjacent each through slot so that a communicant may easily accept a host and a communion cup with wine.

In yet another embodiment, the self-serve, communion containment, presentation and serving device includes a plurality of hinged covers that covers a single through-slot, and when present, a single communion cup aperture.

In another embodiment, the invention is a self-serve, communion containment, presentation and service device for containing, presenting and serving a plurality of edible communion items. In this embodiment, the device comprises: a frame; and a plurality of individual communion-containment units connected to the frame. Each communion-containment unit is configured to contain a single edible communion host. Each of the plurality of individual communion-containment units includes: a platform portion having a platform surface; an opening in the platform portion, the opening configured to receive and position the edible communion item in a predetermined position; and a hinged cover moveable between a first position covering the opening and a second position exposing the opening.

In another embodiment, the invention is a communion service kit that includes a self-serve, communion containment, presentation and service device and a plurality of communion cups configured to fit into communion-cup apertures in the device.

BRIEF DESCRIPTION OF THE FIGURES

The invention can be understood in consideration of the following detailed description of various embodiments of the invention in connection with the accompanying drawings, in which.

Figure 1:
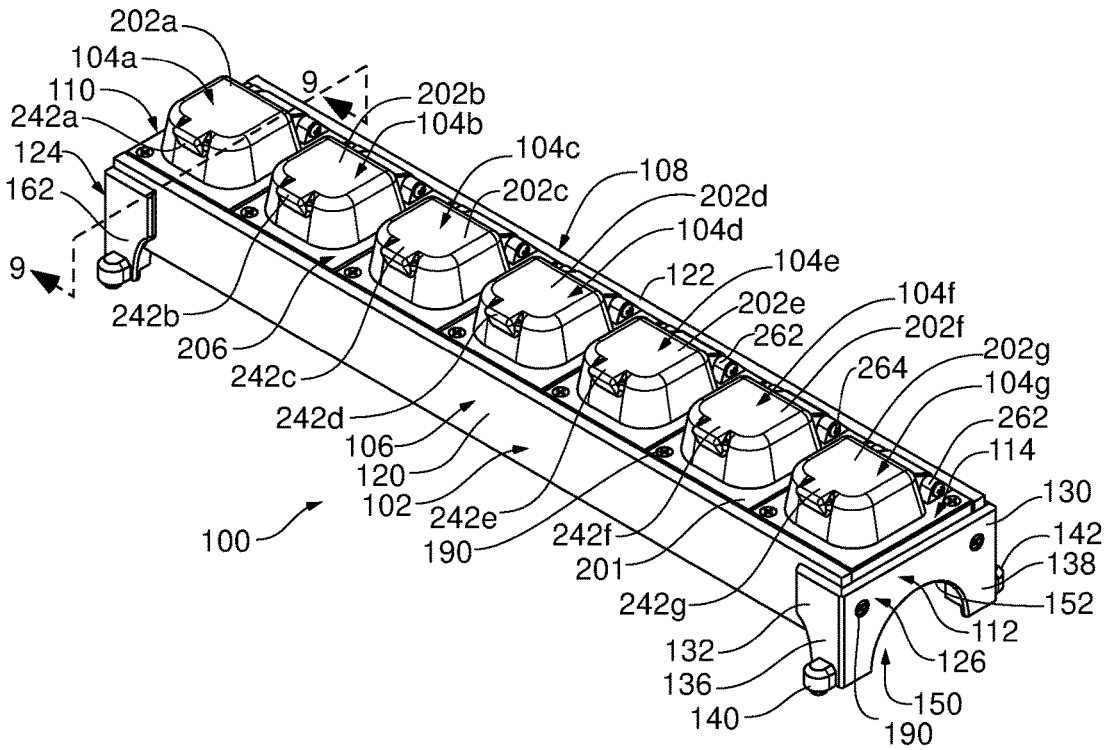
FIG. 1 is a front, top perspective view of a communion-service device, according to an embodiment of the invention.

While the disclosure is amenable to various modifications and alternative forms, specifics thereof have been shown by way of example in the drawings and will be described in detail. It should be understood, however, that the intention is not to limit the invention to the particular embodiments described. On the contrary, the intention is to cover all modifications, equivalents, and alternatives falling within the spirit and scope of the invention as defined by the appended claims.

DETAILED DESCRIPTION

Referring to FIGS. 1-5, an embodiment of a self-serve, communion containment and service device 100 (referred to hereinafter as "communion-service device" 100) for communicant self-service of individual servings of communion is depicted. In the embodiment depicted, communion-service device 100 includes frame 102 and a plurality of individual communion-containment units 104 (labeled individually as units 104*a* to 104*g*). Each individual communion-containment unit 104 is configured to contain a single serving of the Eucharist or "communion," which may comprise a single edible communion item, such as a host, and/or a single serving of a drinkable item or liquid, such as wine or similar, as will be described in further detail below.

In the depicted embodiment, individual communion-containment units 104 are arranged in a row, which may be a single row as depicted in FIGS. 1-10. In other embodiments, such as the embodiment depicted in FIG. 11, which is described in further detail below, communion-service device 100 may comprise more than one row.

In other embodiments, the distribution or layout of the multiple individual communion-containment units 104 may be arranged in other patterns that are not, or do not resemble, linear rows. For example, the multiple individual communion-containment units 104 may be arranged in a circular, spiral or other configuration.

As described further below, the distribution pattern, which could be one or more rows, or other patterns, and the quantity of communion-containment units 104 in a single communion service device 100 may vary depending on the application, or particular needs of a congregation.

Factors determining distribution and quantity may include, but not be limited to, congregation size or number of persons expected to receive communion during a single service, number of Eucharistic ministers, or persons distributing communion (e.g., a smaller congregation, and/or a larger number of Eucharistic ministers may suggest a relatively smaller number of units 104), a position of the Eucharistic ministers relative to communion recipients, an approach direction(s) of communion recipients (e.g., an approach from multiple directions may suggest distributing units 104 in rows facing multiple directions, or not in rows at all, but in a circular pattern), physical attributes of the Eucharistic ministers (e.g., smaller hands may require a smaller or lighter device with fewer units 104), desired timing of distribution (e.g., a larger number of units 104 may facilitate faster distribution by limiting the number of times an empty device 100 must be exchanged for a refreshed or refilled device 100), and other such factors.

As such, it will be understood that while embodiments of communion service device 100 are depicted in the Figures as having the particular distribution pattern of one or more linear rows, and as having a particular number of individual communion-containment units 104, the invention is not limited to only such embodiments.

As described above, the number of individual communion-containment units 104 in each row, and in total for a single-row device 100, may vary depending on a number of factors. In the depicted embodiment, communion-service device 100 includes seven units 104, though it will be understood that the number of individual communion-containment units 104 may be larger or smaller. In an embodiment, the number of individual communion-containment units 104 ranges from four to twenty communion-containment units in a row; in another embodiment, the number of individual communion-containment units 104 ranges from five units to ten units. If too few units 104 are included in a communion-service device 100, a user, such as the Eucharistic minister, will too often need to be replacing empty devices 100 with "full" devices 100 as communicants wait their turn to take communion. Further, too few units 104 may result in a very small device 100 that may be difficult to hold and manage by the Eucharistic minister. On the other hand, if too many communion-containment units 104 are present in a single communion-service device 100, the weight of the device may increase undesirably such that the user or Eucharistic minister experiences fatigue after holding device 100 for a long period of time.

In an embodiment of communion-service device 100 having six to ten communion-containment units 104 in a lengthwise row, both hands of the Eucharistic minister may be used to grasp device 100 along its length with sufficient space for all fingers. In one such embodiment, a length of such an embodiment is constrained to a range of eight to fourteen inches.

Still referring to FIGS. 1-5, in an embodiment, communion-service device 100 defines a front side 106 (which may also be a communicant-approach side), rear side 108 (which may also be a Eucharistic-minister-holding side), first end 110, second end 112, top side 114 and bottom side 116. A length of communion-service device 100 extends generally from first end 110 to second end 112; a width of communion-service device 100 extends generally from front side 106 to rear side 108; and a height of communion-service device 100 extends from bottom side 116 to top side 118.

In an embodiment, frame 102 comprises front frame-portion 120, rear frame portion 122, first frame-end portion 124 and second frame-end portion 126. In an embodiment, each of front frame-portion 120 and rear fame-portion 122 comprises a rectangular shape that extends along a length of communion-service device 100. First frame-end portion 124 connects to front frame portion 120 and rear frame portion 122 at first end 110 of communion-service device 100; second frame-end portion 126 connects to front frame portion 120 and rear frame portion 122 at second end 112 of communion-service device 100.

Each of first frame-end portion 124 and second frame-end portion 126 extends generally in a widthwise direction to connect front and rear frame portions 120 and 122 respectively. In an embodiment, and as depicted, portions of each of first frame-end portion 124 and second frame-end portion 126 may also extend in a lengthwise direction at the front and rear sides 106 and 108 of communion-service device 100 so as to securely connect to front and rear frame portions 120 and 122. In other embodiments, each of first frame-end portion 124 and second frame-end portion 126 only substantially extend in the lengthwise direction, and do not substantially extend in a widthwise direction.

In the embodiment depicted, second frame-end portion 126 includes end portion 130, front side portion 132, rear side portion 134, first leg 136, second leg 138, first foot 140 and second foot 142.

End portion 130 extends in a widthwise direction, and is generally flat in a plane extending from top to bottom and in a plane extending from front to rear. End portion 130 may define a recess, cut-out portion, or semi-circular void 150, such that end portion 130 defines a lower, widthwise-extending arcuate edge 152. In other embodiments, void 150 may comprise other shapes, such as a rectangular shape. Void 150 in end portion 130 aids in defining legs 136 and 138, and provides a space for receiving a portion of a user's hand so as to more easily and securely grasp and hold communion-service device 100.

Front side portion 132 may be connected to front frame-portion 120, while rear side portion 134 may be connected to rear frame-portion 122.

First leg 136, in the embodiment depicted, is defined by portions of end portion 130 and front side portion 132, which extend in a downward direction. Similarly, second leg 138, in the embodiment depicted, is defined by portions of end portion 130 and rear side portion 134, which also extend in a downward direction.

First leg 136 and second leg 138 may respectively include first foot 140 and second foot 142. Feet 140 and 142 support and bear a portion of the weight of communion-service device 100, and in an embodiment, may each include a non-slip pad or material that prevents communion-service device 100 from sliding on the surface onto which device 100 is placed.

In the embodiment depicted, first frame-end portion 124 is substantially the same as second frame-end portion 126 described above, and includes end portion 160, front side portion 162, rear side portion 164, third leg 166, fourth leg 168, third foot 170 and fourth foot 172.

End portion 160 extends in a widthwise direction, and is generally flat in a plane extending from top to bottom and from front to rear. End portion 160 may define a recess, cut-out portion, or semi-circular void 180, such that end portion 160 defines a lower, widthwise-extending arcuate edge 182. In other embodiments, void 180 may comprise other shapes, such as a rectangular shape. Void 180 in end portion 124 aids in defining legs 166 and 168, and provides a space for receiving a portion of a user's hand so as to more easily and securely grasp and hold communion-service device 100.

Front side portion 162 may be connected to front frame-portion 120, while rear side portion 164 may be connected to rear frame-portion 122.

Third leg 166, in the embodiment depicted, is defined by portions of end portion 160 and front side portion 162, which extend in a downward direction. Similarly, fourth leg 168, in the embodiment depicted, is defined by portions of end portion 160 and rear side portion 164, which also extend in a downward direction.

Third leg 166 and fourth leg 168 may respectively include third foot 170 and fourth foot 172. Feet 170 and 172 support and bear a portion of the weight of communion-service device 100, and in an embodiment, may each include a non-slip pad or material that prevents communion-service device 100 from sliding on the surface onto which device 100 is placed.

Figure 5:
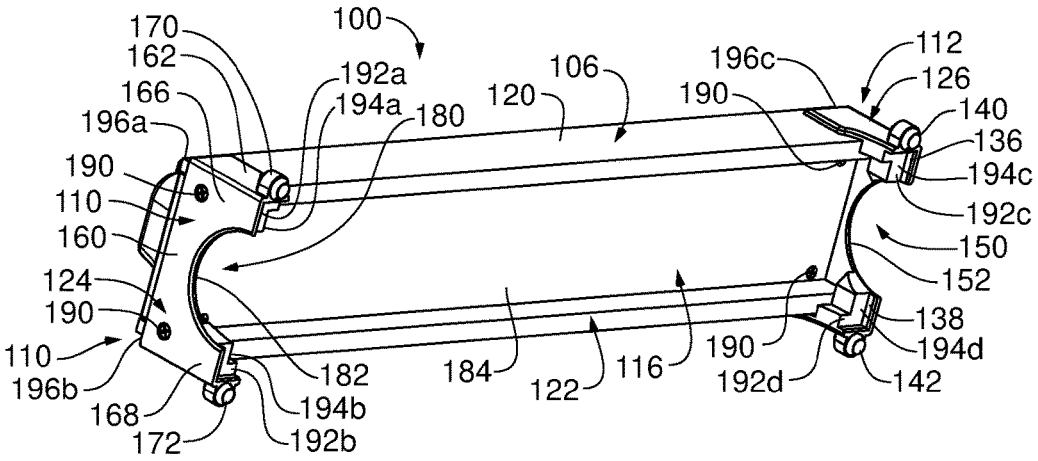
FIG. 5 is a bottom, perspective view of the communion-service device of FIG. 1, depicting an optional bottom plate.

Referring specifically to FIG. 5, in an embodiment, frame 102 may also include an optional bottom cover 184. In an embodiment, bottom cover 184 substantially extends the length and the width of communion-service device 100, covering bottom side 116 of device 100, and creating a cavity within device 100. In an embodiment that includes bottom cover 184, and spilled liquid or fragments of hosts will be contained within the cavity. In the depicted embodiment, cover 184 may be positioned below communion-containment units 104, and above voids 150 and 180, so as to be nearer the cup and host.

Referring again to FIGS. 1-5, frame 102 may comprise one or more of a variety of materials, or combination of materials, such as a polymer, wood or metal. Further, the various components of frame 102 may be held together by fasteners, such as fasteners 190, which may comprise screws, threaded bolts with nuts, or other types of fasteners. In other embodiments, all or some of the components of frame 102 may be held together by an adhesive.

Further, components of frame 102, including front frame portion 120, rear frame portion 122, first frame-end portion 124 and second frame-end portion 126, and their respective components, if any, may not comprise separate and connected components, but may comprise integrated components. For example, in an embodiment where communion-service device 100 comprises a polymeric material, all components of frame 102 may be a single, molded polymeric structure. In another embodiment, and as described further below with respect to FIG. 10, frame 102 may comprise multiple integrated components, such that frame 102 comprises two integrated pieces that comprise the various components and features described above with respect to FIGS. 1-5.

Figure 6:
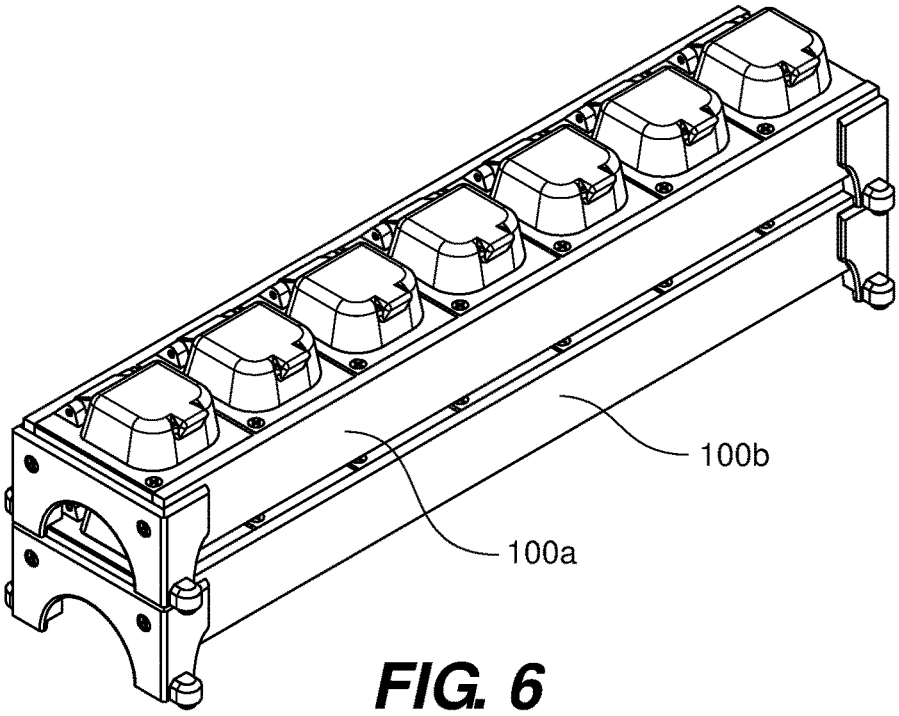
FIG. 6 is a perspective view of two communion-service devices stacked on top of each other, according to an embodiment.

Referring to FIG. 6, in an embodiment, communion-service devices 100 may be stackable or capable of nesting, such that one communion-service device 100 can securely sit atop another communion-service devices 100. As depicted, a first communion-service device 100*a* sits securely atop a second communion-service device 100*b*. As described further below, a top communion-service device 100, such as device 100*a*, is configured to receive a portion of a communion-service device 100 on which it sits, such as device 100*b*, at its four corners so as to contact top corners of the device below.

Figure 2:
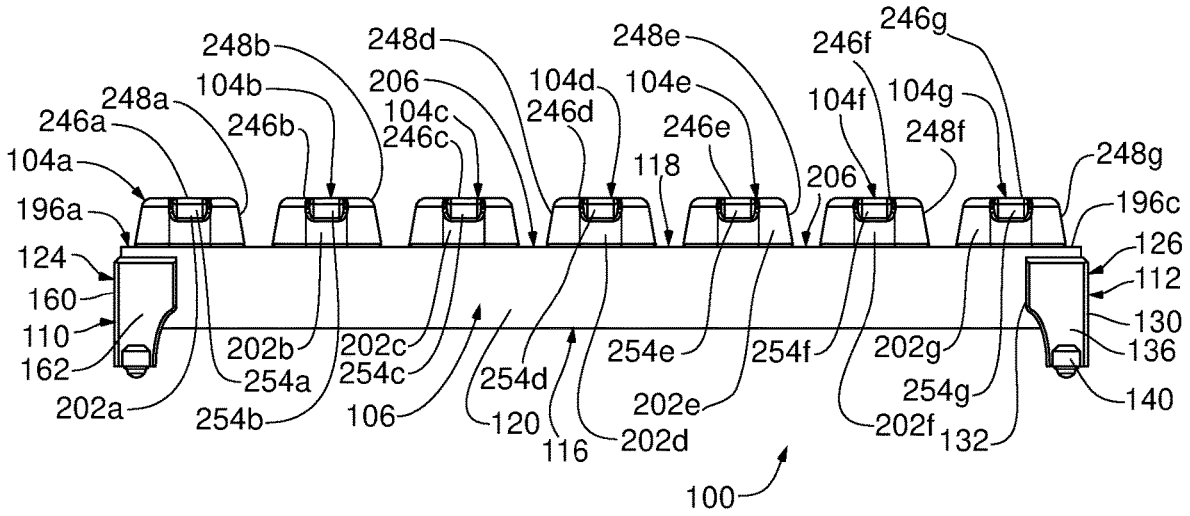
FIG. 2 is a front view of the communion-service device of FIG. 1.
Figure 3:
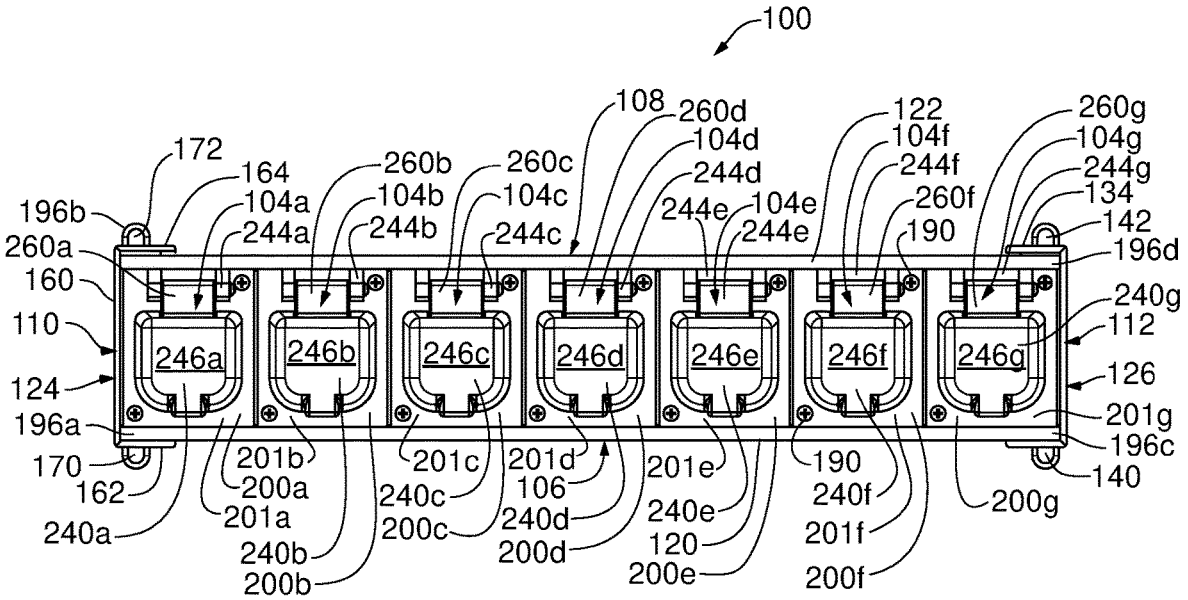
FIG. 3 is a top view of the communion-service device of FIG. 1.
Figure 4:
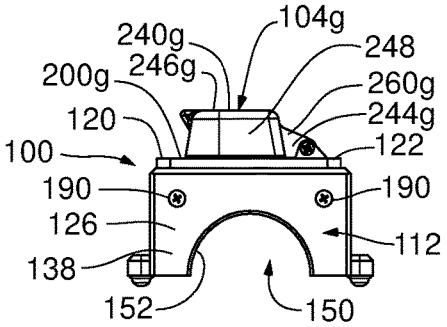
FIG. 4 is a right-side view, or second-end view, of the communion-service device of FIG. 1.

Referring to FIGS. 3, 4 and 5, frame 102 may also include a plurality of corner blocks 192 located respectively at each of the four lower, inside corners of communion-service device 100, i.e., block 192*a* at first end 110, front corner; block 192*b* at first end 110, rear corner; block 192*c* at second end 112, front corner; and block 192*d* at second end 112, rear corner. In an embodiment, each corner block 192 forms an "L" shape in the horizontal, lengthwise-widthwise plane, though corner blocks 192 may form other shapes, such as a square or rectangle, and so on. Each corner block 192 defines a surface 194, labeled as 194*a* to 194*d*, which in an embodiment is substantially flat, and configured to contact an upper corner 196 of a communion-service device 100 located below blocks 192 and their respective surfaces 194. Referring also to FIGS. 2-3, four upper corners 196*a* to 196*d* that abut surfaces 194*a* to 194*d*, respectively, of another device 100, are depicted. In an embodiment, and as depicted, four upper corners 196*a* to 196*d* may comprise portions of front frame-portion 120, rear frame-portion 122, portions of communion-containment units 104, e.g., platform 200, such as platform 200*a* to 200*g* (see further description below regarding platforms 200). These portions of frame 102 may extend further in a vertical direction (lower to upper side) than first and second frame-end portions 124 and 126 so as to fit into the lower corners of a stacked device 100 above.

When present, in addition to enabling a stacking feature of the device, each corner block 192 also provide structural support for its respective frame-end portion and portions thereof.

Referring specifically to FIGS. 1-3, communion-service device 100, in an embodiment, includes multiple communion-containment units 104 arranged serially along a length of device 100. In an embodiment, each communion-containment unit 104 includes a communion-containment unit platform 200, and a pivoting or hinged cover assembly 202.

In the embodiment depicted, communion-service device 100 includes seven individual communion-containment units 104, labeled as 104*a* to 104*g*, and therefore includes seven communion-containment unit platforms 200, which are individually labeled 200*a* to 200*g* for the sake of illustration. In an embodiment and as depicted, platforms 200 are separately formed structures arranged side-by-side to one another. Together, individual unit 104 platforms 200 form device 100 platform 206. In an embodiment, platform 206 substantially extends the length of communion-service device 100. In the depicted embodiment, and as described above, platforms 200*a* to 200*g* are separate structures arranged adjacent to one another. However, it will be understood that platforms 200*a* to 200*g* may comprise a single integrated structure, such that device platform 206 is a single, unitary structure. In one such embodiment, device platform 206 comprises a polymer or polymeric material manufactured using an injection-molding process. Unit platforms 200 and device platform 206 comprising of a polymer or polymeric material may be advantageous in that the platform or platforms may withstand being washed multiple times without being damaged, such as when being washed in an automatic dishwasher that uses high-pressure, high-temperature water.

In an embodiment, platform 200, including platforms 200*a* to 200*g*, or platform 206, may comprise a dark color so as to contrast with the light color of a host, making easier for a communicant to see the host. In an embodiment, a color of platform 200 or 206 will be darker than a color of a host. In one particular embodiment, a color of platform 200 or 206 is one or more of the follow colors: black, blue, green, and red, while the lighter colors of a host may be white or beige, or another color that has a color hue that is not as dark as the host.

Figure 7:
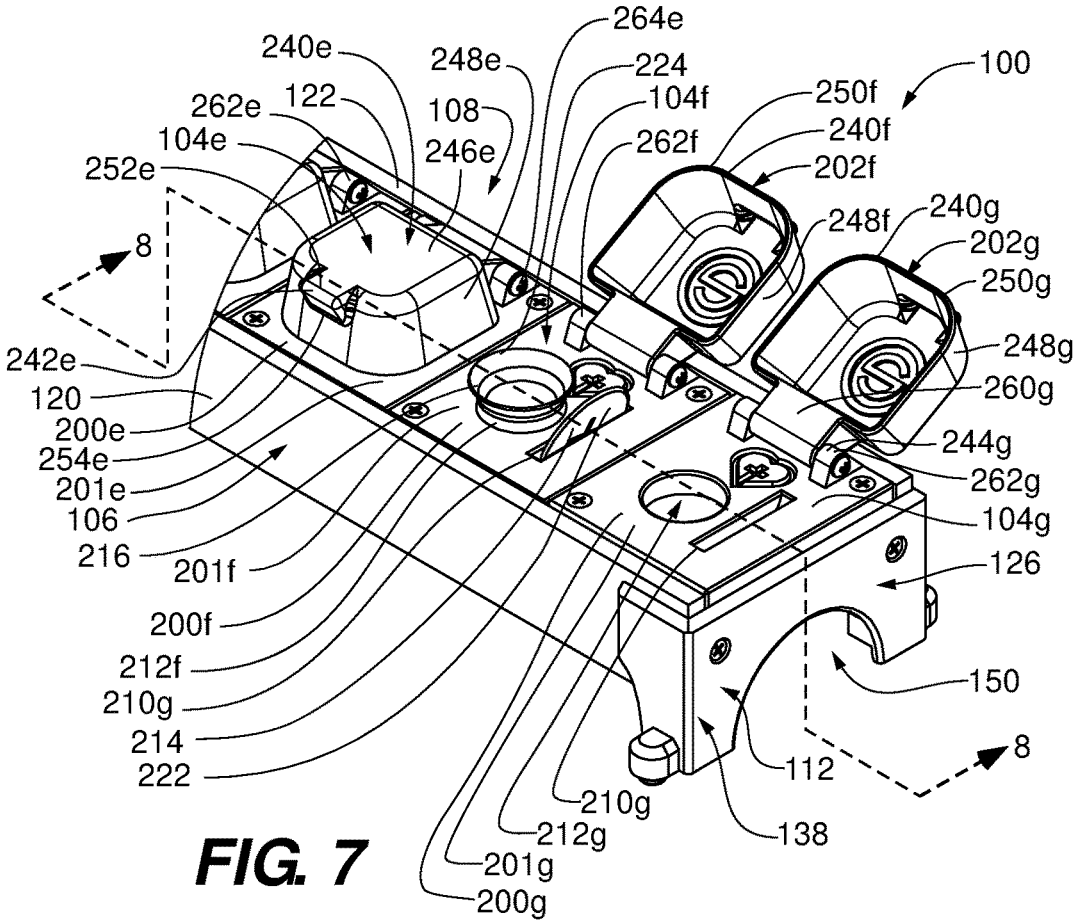
FIG. 7 is a perspective view of an end of a communion-service device, depicting two hinged cover assemblies in an open position, according to an embodiment.

Referring to FIG. 7, a partial front perspective view of communion-service device 100 depicts three communion-containment units 104, namely, communion-containment unit 104*g* at second end 112, communion-containment unit 104*f* located next to unit 104*g*, and communion-containment unit 104*e* located next to unit 104*f*. In FIG. 7, two pivoting covers 202, labeled as 202*g* and 202*f*, are depicted in an open position, while one pivoting cover, cover 202*e*, is depicted in a closed position. Further description of pivoting covers 202 is provided below.

Figure 8:
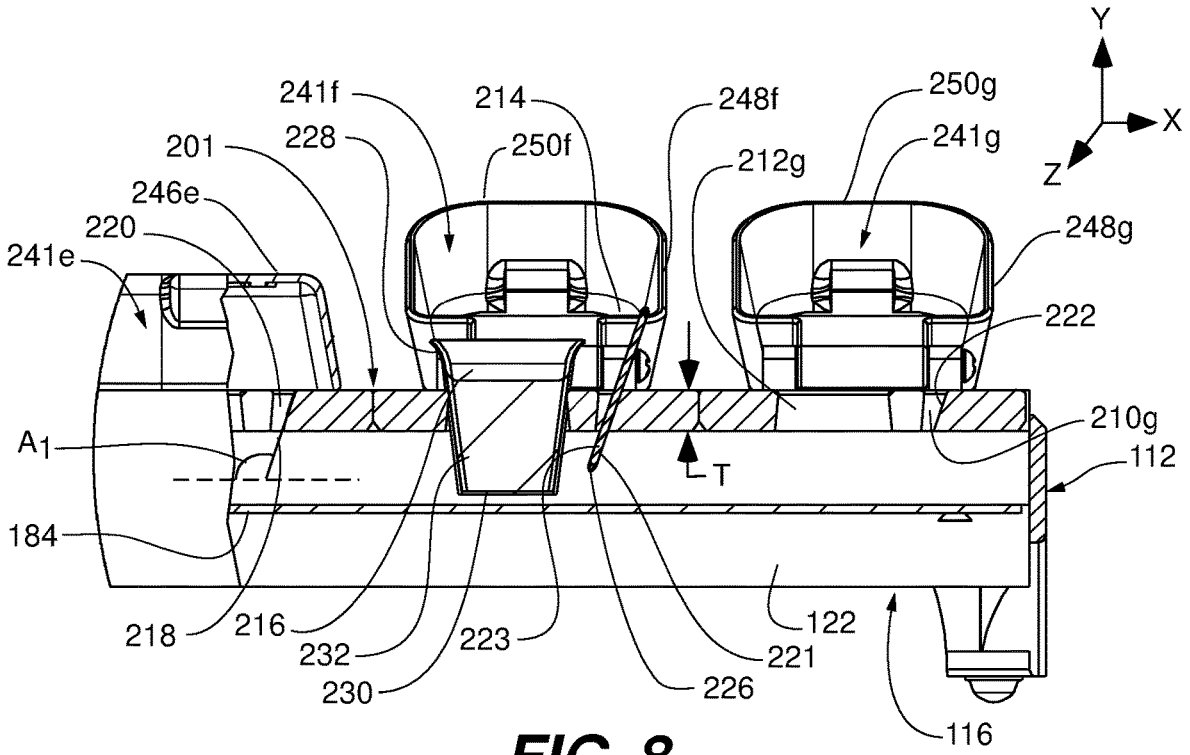
FIG. 8 is a lengthwise, cross sectional view of the communion-service device of FIG. 7.
Figure 9:
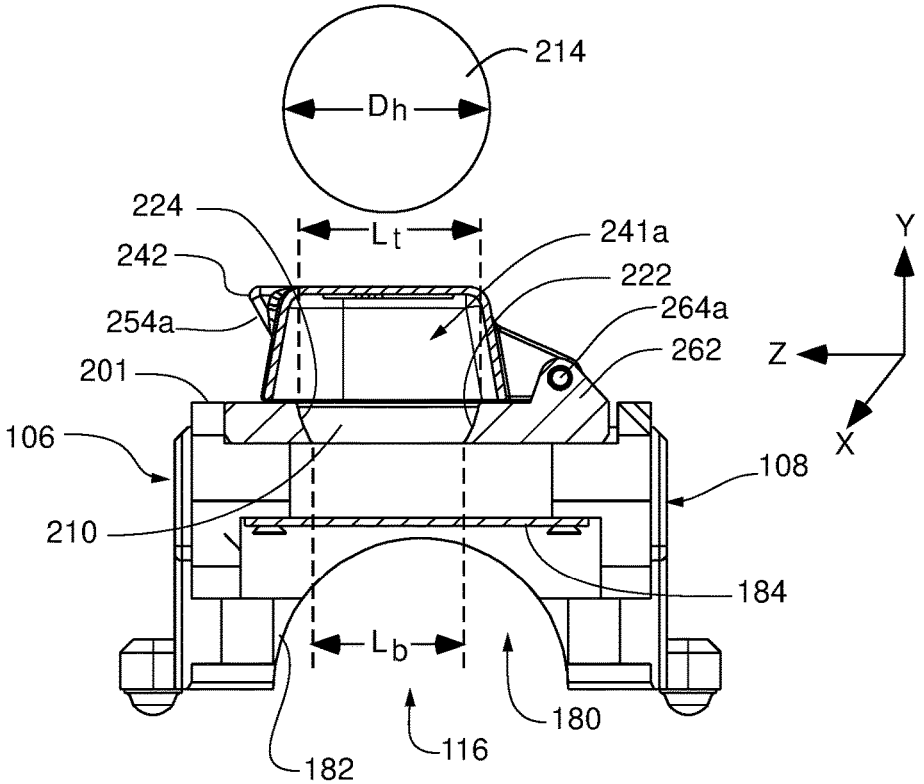
FIG. 9 is a cross sectional view near an of the communion-service device depicted in FIG. 1, according to an embodiment.

Referring to FIGS. 7-9, each unit platform 200 defines a top surface 201, a host opening, hole or slot 210 ("slot" 210 hereinafter) for receiving a host 214 and a cup-receiving aperture 212 for receiving a cup 216.

Referring specifically to FIGS. 7, 8 and 9, communion-containment unit 104*g* includes platform 200*g* that defines host slot 210*g* and cup-receiving aperture 212*g*; communion-containment unit 104*f* includes platform 200*f* that defines host slot 210*f* and cup-receiving aperture 212*f*. Communion-containment unit 104*f* depicts a host 214 located in slot 210*f* and a small cup 216 that may include wine or another liquid, in cup-receiving aperture 212*f*.

In an embodiment, host 214 is a relatively thin, disc-shaped edible item defining first circular face 221, second circular face 223 and circumferential edge 226.

In an embodiment, cup 216 comprises a generally-frustoconical shape that includes top portion 228, bottom portion 230 and outer surface 232. However, it will be understood that cup 216 could comprise other shapes formed to accommodate a shape of cup-receiving aperture 212.

As depicted, and in an embodiment, each slot 210 is adjacent to cup-receiving aperture 212. In an embodiment slot 210 may be a through slot or a blind slot. Similarly, cup-receiving aperture 212 may be a through aperture or a blind aperture. Further, although opening 210 is described as a slot, which generally is understood to have a length greater than a width, as depicted, in alternative embodiments, opening 210 may form shapes other than slots, such as a square, oval or other shape chosen to accommodate particular sizes or features of the communion host or item. Each slot 210 of communion-containment unit 104 defines a top opening on platform 200 that generally extends in a widthwise direction, which is also a front-side 106 to rear-side 108 direction. Slots 210 and cup-receiving apertures 212 are arranged serially as sets from a first end 110 to a second end 112. In an embodiment, and as depicted each slot 210 and each cup-receiving aperture 212 is also arranged adjacent each other in a lengthwise direction extending between first and second ends 110 and 112, such that host 214, from the perspective of a communicant approaching front side 106 of communion-service device 100, is on the right side of platform 200 (nearer second end 112), cup 216 is on the left side of platform 200 (near first end 110), and edge 226 of host 214 is facing the communicant. In another embodiment, relative positions of host slot 210 and cup aperture 212 may reversed, with host slot 210 closer to first end 110 (communicant left-hand side) as compared to its companion cup aperture 212, which is closer to second end 112 (communicant right-hand side).

Although in an embodiment, a host slot 210 and a cup aperture 212 on a common platform 200 may be arranged in a front-to-back arrangement, arranging host slot 210 next to cup aperture 212 in a left-right arrangement as depicted in the Figures, as opposed to a front-back arrangement, provides a number of advantages. A primary advantage is that when a communicant approaches front side 106 and views a communion-containment unit 104 and its contained host 214 and cup 216, the side-by-side arrangement prevents host 214 from blocking from view any portion of cup 216, and vice versa, such that both host 214 and cup 216 may be more easily viewed, thus making it easier for a communicant to pick up host 214 and cup 216. This can be important to communicants with impaired or poor vision, including the elderly.

A feature of communion-service device 100 is that the device enables a communicant to easily see and pick up both the host 214 and the cup 216.

Referring specifically to FIG. 8, a feature of communion-service device 100 that enables a communicant to more easily perceive a relatively small host 214 relates to the shape of slot 210, which results in host 214 resting at a left-to-right angle on its first face 221 in a slot 210 of communion-service device 100, so as to expose surface 224 of host 214, rather than only host edge 226, when viewed by a communicant from above (top to bottom direction).

Referring also to FIGS. 8 and 9, each host slot 210 is defined by first slot-wall surface 218, second slot-wall surface 220, third slot-wall surface 222, and fourth slot-wall surface 224. First slot-wall surface 218 is opposite second slot-wall surface 220, and third slot-wall surface 222 is opposite to fourth slot-wall surface 224.

In an embodiment, and as depicted, each slot 210 is a through slot, having a top opening and a bottom opening. In another embodiment, each slot 210 may be a blind slot, having only a top opening.

Referring specifically to FIG. 8, in an embodiment, first slot-wall surface 218 is "angled" and second slot-wall surface 220 is substantially vertical. More specifically, and with reference to the Cartesian coordinate system with x-y-z axes depicted, wherein the x axis is a lengthwise/first end-second end/left-right axis, the y axis is a bottom-top axis, and the z axis is a front-back axis, first slot-wall surface 218 defines an inclined plane, wherein a vector normal to surface 218 and its theoretical plane extends solely in the x-y plane, generally in a "negative" x direction (from second end 112 toward first end 110). Surface 218 defines an obtuse angle A1 with the x-z plane (in other words, surface 218 angles upwardly from bottom end 116 and towards a right/second end 112 of device 100. Second slot-wall surface 220 defines a plane that is the same as the y-z plane, in other words, surface 220 extends in a top-to-bottom direction and a front-to-back direction, with a normal vector that extends in the x direction.

Referring to FIG. 9, third slot-wall surface 222 defines an inclined plane, wherein a vector normal to the surface and its associated plane extends solely in the y-z plane and generally toward front side 106 of device 100, or in the z direction. In other words, surface 222 slopes upwardly and rearwardly away from bottom end 116 of device 100, facing generally toward front side 106. Fourth slot-wall surface 224 defines an inclined plane, wherein a vector normal to the surface and its plane also extends solely in the y-z plane, but in the negative z direction. In other words, surface 224 slopes upwardly and towards front side 110, facing generally toward rear side 108.

As is evident from the figures, due to angled surfaces 222 and 224, a top side of slot 210 has a front-to-rear length Lt that is longer than a front-to-rear length Lb. In this embodiment, the diameter of host 214 determines how host 214 will be positioned within slot 210, and more specifically, how much of host 214 will be within, below and above slot 210.

At a minimum, host diameter Dh must be at least the same as, or slightly greater than, slot bottom length Lb, or host 214 would fall through slot 210 and would not be held by platform 200. The larger the host diameter Dh, the less that host 214 will be held within slot 210, and the more that host 214 will be outside of slot 210 and project above platform 200. Generally, holding host 214 in slot 210 such that a significant portion of host 214 projects outside of slot 210 and above platform 200, the more visible host 210 will be to a communicant. However, if too much of host 214 is within slot 210 and below platform 200, the harder it will be for a communicant with poor or impaired vision to see the host. On the other hand, if host diameter Dh is too large in relation to slot 210, only a small portion of host 214 will fit into slot 210, and host 214 may more easily be displaced from slot 214 when communion-service device 100 is subjected to various forces during use.

In the embodiment depicted, host diameter Dh is larger than bottom slot diameter Lb, and is approximately the same as top slot diameter Lt, such that approximately half of host 214 is outside of slot 210 and above top surface 201 of platform 200.

In an alternate embodiment, host diameter Dh is larger than both bottom slot diameter Lb and top slot diameter Lt, such that more than half of host 214 projects out of slot 210 and resides above platform 200. Such an embodiment maximizes the amount of circular face 223 of host 214 that is visible to a communicant when viewed looking down on communion-service device 210. In one such embodiment, host diameter Dh ranges from 105% to 150% of top length Lt of slot 210. More particularly, host diameter Dh may range from 110% to 125% of top length Lt of slot 210.

In another alternate embodiment, a certain amount of visibility is sacrificed for increased stability of host 214 in slot 210. In such an embodiment, diameter Dh of host 214 is larger than bottom length Lb of slot 210, but smaller than top length Lt. In such an embodiment, more than half of host 214 is recessed below top surface 201 of platform 200, thereby increasing the stability of host 214 within slot 210, making it less likely that host 214 may accidentally be dislodged from slot 210, such as when being initially grasped by a communicant or when communion-service device 100 is subjected to side-to-side or up-and-down forces. In one such embodiment, host diameter Dh ranges from 75% to 99% of top length Lt of slot 210. More particularly, host diameter Dh may range from 85% to 95% of top length Lt of slot 210.

Further with respect to slot 210, in an embodiment, a top width (first end 110 to second end 112 direction) of slot 210 is larger than a bottom width of slot 210, and a bottom width of slot 210 is at least as large as a thickness of host 214, so that at least portion of host 214 may be inserted into slot 210. In an embodiment, a vertical or minimum height or depth of slot 210 is determined by, and therefore equal to, a thickness T of platform 200.

Referring to FIGS. 7, 8 and 9, in an embodiment that assists a communicant in perceiving cup 216 and easily grasping the cup, cup aperture 212 is sized to have a diameter that is smaller than a top, maximum diameter of cup 216. As such, an outer surface of cup 216 contacts platform 200 below a very top, or a lip, of cup 216, causing a portion of cup 216 to project above top surface 201 of platform 200. In one embodiment, and as depicted, approximately 25% of a height of cup 216 projects above top surface 201; in other embodiments, 10% to 50% of a height of cup 216 projects above top surface 201. The more height projecting above surface 201, the easier it is for a communicant to see and grasp cup 216. However, if too much of cup 216 projects above platform 200, the cup may become unstable in platform 200, and/or may be prone to spilling.

Referring again to FIGS. 1-4 and 7, as described briefly above, each communion-containment unit 104, in addition to including a platform 200, also includes a hinged-cover assembly 202, labeled as hinged-cover assemblies 202*a* to 202*g*. FIGS. 1-4 depict each communion-containment unit 104 and hinged cover assembly 202 in a closed position. Each hinged-cover assembly 202 includes containment shell 240 (labeled as 240*a* to 240*g*), each defining a communion cavity 241, finger-contact portion 242 and hinge mechanism 244. In an embodiment, containment shell 240, finger-contact portion 242 and portions of hinge mechanism 244 may comprise an integrated structure, such as that depicted in the Figures, and may comprise a variety of materials, including a polymer or polymeric material.

Referring also to FIG. 7, which depicts two communion-containment units 104 with their hinged cover assemblies 202 in their open positions, containment shell 240 forms a cap or cover configured to be placed over host 214 and cup 216, thereby, in conjunction with platform 200, "containing" host 214 and cup 216. In an embodiment, containment shell 240 includes top portion 246 and wall portion 248. In the depicted embodiment, top portion 246 is generally flat, though in alternate embodiments, top portion 246 may define other shapes, such as a dome shape, or other shapes. Wall portion 248 is a vertically extending wall portion that extends around the circumference of containment shell 240, and defines a front, rear and sidewall portions. Wall portion 248 is coupled to top portion 246, and may be an integrated structure with top portion 246. Wall portion 248 of containment shell 240 includes edge 250, including 250*f* and 250*g* depicted that is configured to contact top surface 201 of platform 200. In an embodiment, edge 250 is a continuous flat edge that extends around the entire periphery of containment shell 240, with all portions of edge 250 contacting top surface 201 so as to form a sealed enclosure within containment shell 240 when communion-containment unit 104 and hinged cover assembly 202 are in the closed position.

Finger-contact portion 242 may be integral with containment shell 240, and in an embodiment, forms a projection, tab or protrusion extending outwardly and away from an outer surface of shell 240, and intended to be in contact with a digit, i.e., finger or thumb, of a communicant intent on moving hinged cover assembly 202 into an open or closed position. Finger-contact portion 242, in an embodiment, defines top surface 252 and front surface 254, both of which are intended to be in contact with the hand or digit of the communicant. In an embodiment, finger-contact portion 242 may also be integral with top portion 246, such that top surface 250 of top portion 246 is in the same plane as top surface 252 of finger-contact portion 242. In an embodiment, front surface 254 forms an inclined plane that angles in front-to-rear direction, as depicted.

Hinge mechanism 244 may comprise any of a variety of known hinge joints, including the hinge joint and mechanism depicted, which may be understood to be a barrel hinge. In the depicted embodiment, hinge mechanism 244 includes shell portion or shell leaf 260, hinge knuckles 262 and hinge pin 264. Shell portion 260 is connected to, and projects outwardly and away from, containment shell 240 and may be integrated with containment shell 240. In an embodiment, containment shell 240, finger-contact portion 242, and shell portion 260 of hinge mechanism 244 may be a single integrated structure, such as a single molded polymer or polymeric structure. Hinge knuckles 262 are secured to top surface 201 of platform 200, and in some embodiments, may be integral with platform 200.

Hinge pin 264 is inserted through openings in hinge knuckles 262 and shell portion 260, such that containment shell 240 is pivotally connected to platform 200, and therefore can be pivoted between an open position and a closed containment position, or positions therebetween.

In an embodiment, hinge mechanism 244 does not impart a bias on containment shell 240, such that when containment shell 240 is pivoted to an open position wherein host 214 and cup 216 are exposed and available, containment shell 240 stays in the open position after a communicant ceases to contact finger-contact portion 242, or in general, when a communicant releases hinged cover assembly 202. The use of a hinge mechanism that is not biased makes it easier for a communicant to take host 214 and cup 216 from device 100 because hinged cover assembly 202 stays in the open position, and does not require being held open while removing host 214 and 216.

However, in alternate embodiments, hinge mechanism 244 may include a spring or other biasing member that imparts a closing force on containment shell 240, causing, or allowing, containment shell 240 to move to a closed position without the need of a communicant or other user to apply a separate closing force to hinged cover assembly 202.

In the closed position, with edge 250 in contact with top surface 201 of platform 200, containment shell 240 covers host slot 210 and cup aperture 212, as well as host 214 and cup 216 when present. In the open position, whereby containment shell 240 is pivoted upwardly and away from surface 201, such as depicted in FIG. 7, a communicant may easily perceive and grasp host 214 and cup 216.

In addition to improving visibility of host 214 and cup 216, and making host 214 and cup 216 easier to grasp, the containment structures and features of communion-service device 100 described above improve the safety and sanitation of the process of distributing and serving communion. For example, rather than grouping hosts 214 together, or drinking from a common cup, communion-service device 100 contains or separates individual servings, making only one host 214 and one cup 216 available for each individual communion-containment unit 104. As such, a communicant properly taking communion touches only one communion-containment unit 104, which ideally means touching only hinged cover assembly 202, and perhaps platform 200, of a particular communion-containment unit 104, thereby minimizing potential spread of disease via human contact with device 100.

Figure 10:
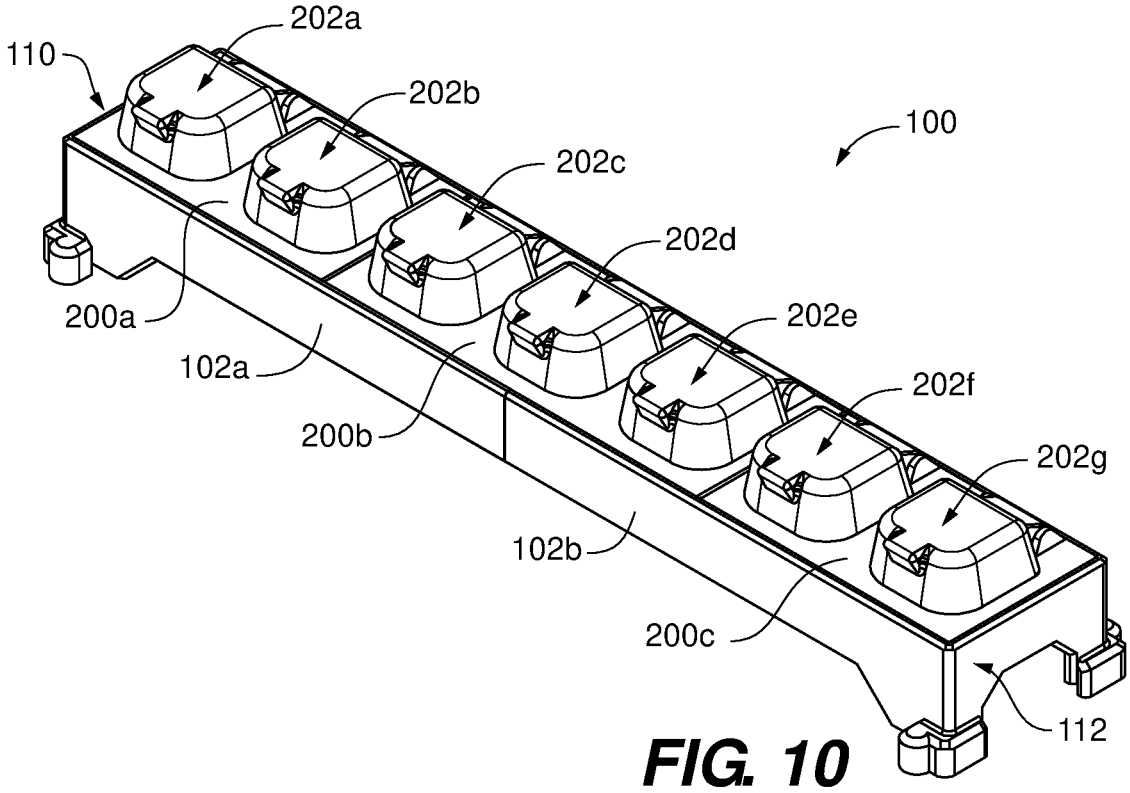
FIG. 10 is a front perspective view of a communion-service device, according to another embodiment.
Figure 11:
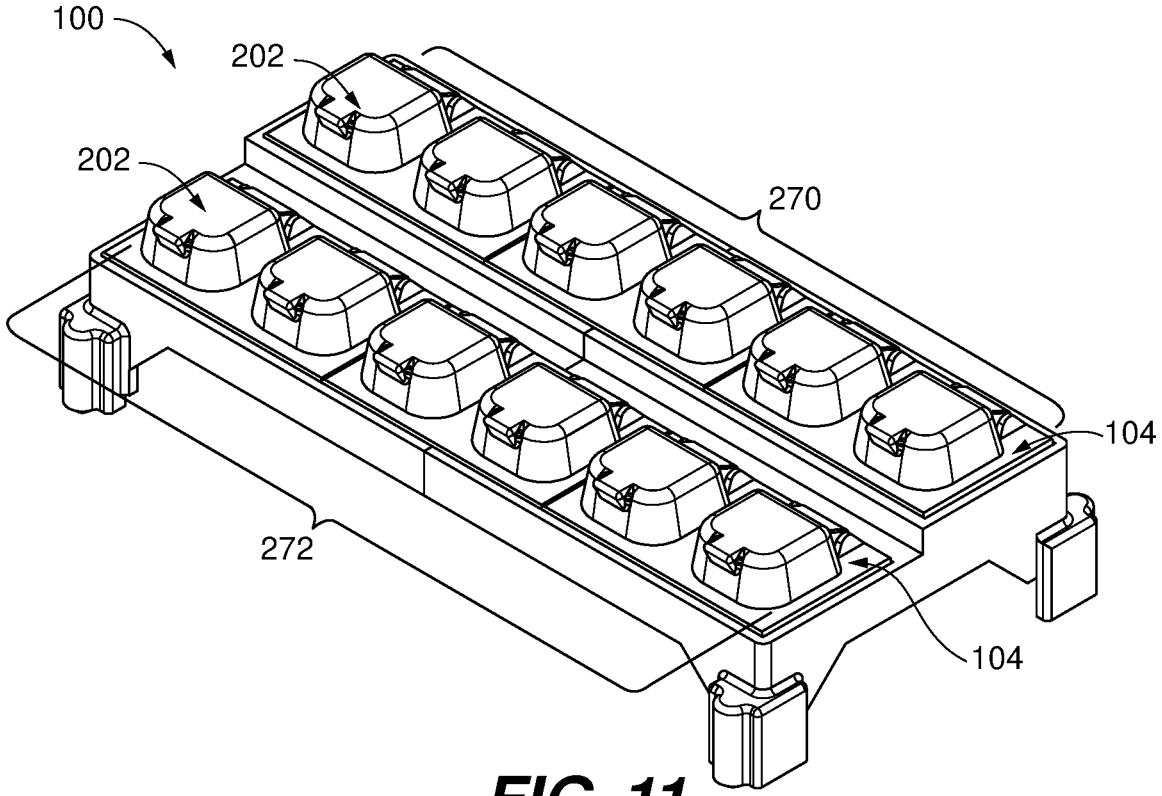
FIG. 11 is a front perspective view of a communion-service device, according to yet another embodiment.

The features and benefits of communion-service device 100 extend and apply to various embodiments of the invention, such as those depicted in FIGS. 10 and 11.

Referring to FIG. 10, communion-service device 100 having an alternate embodiment of frame 102 and platform 206 is depicted. This alternate embodiment of device 100 is substantially the same as the embodiment described above with respect to FIGS. 1-9, except that frame 102 is a simplified structure comprising frame portion 102*a* and frame portion 102*b*. Further, multiple individual communion-containment units 104 may share a common platform 200.

In this embodiment, frame 102 comprises a two-piece structure comprising frame portions 102*a* and 102*b*. Rather than having structurally separate frame-end portions with their own separate end and side portions, and separate front and rear frame portions, frame 102 primarily comprises only two frame portions, 102*a* and 102*b*, which in an embodiment are substantially the same for ease of manufacturing and assembly.

Further, in some embodiments, platforms 200 may extend to multiple communion-containment units 104. In the embodiment depicted, platform 200*a* is used with two hinged cover assemblies 202, i.e., 202*a* and 202*b*, platform 200*b* is used with three hinged cover assemblies 202*c*, 202*d*, and 202*e*, and platform 200*c* is used with two hinged cover assemblies 202*f* and 202*g*.

Referring to FIG. 11, in another alternate embodiment, device 100 may include multiple rows of individual communion-containment units 104. In the embodiment depicted, device 100 includes two rows of communion containment units 104, including a first row 270 and a second row 272. The number of rows of communion-containment units 104 may include more than two rows, and may contain three or more rows, as also described above.

In this particular embodiment of communion-service device 100, rows 270 and 272 are at different elevations, one higher than the other. By having one row being higher than another, a communicant may more easily move hinged cover assembly 202 in a first row 270 from a closed position to an open position, without contacting a hinged cover assembly 202 from the second row.

In addition to the inventive devices described above, unique methods of safely and efficiently making hosts 214 and cups 216 available to communicants, and methods of using device 100 to take communion, i.e., take a single host 214 and a single cup 216 are included herein.

In an embodiment, and referring to FIGS. 1-11 above, a method of making multiple, single servings of a host 214 and/or a cup 216 available to a recipient or communicant, includes providing a communion-service device 100 having multiple communion-containment units 104; opening each of the communion-containment units 104 by applying pressure to a finger-contact portion of a hinged cover assembly 202 of each unit 104; inserting a single host 214 into an angled single slot 210, thereby causing the host to cant at a non-acute angle relative to a top surface 201 of device 100; inserting a single cup 216 having a top diameter into a single cup aperture 212 having a diameter smaller than the top diameter, thereby causing the cup to project above the top surface 201; moving a position of the hinged cover assembly 202 to a closed position, thereby containing an individual serving of a host 214 and a cup 216; and presenting the communion-service device 100 to a plurality of persons.

In an embodiment, a method of taking an individual communion serving comprises approaching a communion-service device 100 at a front side 106 of the device 100; moving a containment shell 240 of a hinged cover assembly to an open position, thereby exposing a single host 214 in a slot 210; grasping the host 214 and removing the host from the slot. In other embodiments, such a method may also comprise grasping a cup 216 and removing the cup 216 from a cup aperture.

The embodiments above are intended to be illustrative and not limiting. Additional embodiments are within the claims. In addition, although aspects of the present invention have been described with reference to particular embodiments, those skilled in the art will recognize that changes can be made in form and detail without departing from the spirit and scope of the invention, as defined by the claims.

Persons of ordinary skill in the relevant arts will recognize that the invention may comprise fewer features than illustrated in any individual embodiment described above. The embodiments described herein are not meant to be an exhaustive presentation of the ways in which the various features of the invention may be combined. Accordingly, the embodiments are not mutually exclusive combinations of features; rather, the invention may comprise a combination of different individual features selected from different individual embodiments, as understood by persons of ordinary skill in the art.

Any incorporation by reference of documents above is limited such that no subject matter is incorporated that is contrary to the explicit disclosure herein. Any incorporation by reference of documents above is further limited such that no claims included in the documents are incorporated by reference herein. Any incorporation by reference of documents above is yet further limited such that any definitions provided in the documents are not incorporated by reference herein unless expressly included herein.

For purposes of interpreting the claims for the present invention, it is expressly intended that the provisions of Section 112, sixth paragraph of 35 U.S.C. are not to be invoked unless the specific terms "means for" or "step for" are recited in a claim.

What is claimed:

1. A self-serve, communion containment, presentation and service device that includes a first end, second end, front side, rear side, top side and bottom side, the device comprising:

a frame;

a platform attached to the frame, the platform including a top surface and defining a plurality of through slots configured to receive communion hosts; and a plurality of hinged covers covering the plurality of slots, each hinged cover of the plurality of hinged covers configured to cover only one slot of the plurality of slots when the hinged cover is in a closed position, wherein each slot of the plurality of slots defines a length extending in a direction from the front side to the rear side, a width extending in a direction from the first end to the second end, and a depth extending in a direction from the top side to the bottom side, the length being greater than the width, and wherein each slot is defined at least in part by a first slot-wall surface located opposite a second slot-wall surface, the first slot-wall surface defined by a plane that is inclined with respect to a plane formed by the second slot-wall surface, such that the first slot-wall surface is not parallel to the second slot-wall surface.

2. The self-serve, communion containment, presentation and service device of claim 1, wherein the plane of the first slot-wall surface defines an acute angle with a plane defined by the top surface of the platform.

3. The self-serve, communion containment, presentation and service device of claim 1, wherein the platform further comprises a plurality of apertures configured to receive a communion cup, each aperture of the plurality of apertures located adjacent to one slot of the plurality of slots.

4. The self-serve, communion containment, presentation and service device of claim 3, wherein each aperture of the plurality of apertures is covered by only one of the plurality of hinged covers when the one hinged cover is in the closed position.

5. The self-serve, communion containment, presentation and service device of claim 1, wherein the plurality of through slots are aligned in a first lengthwise row extending between the first end and the second end.

6. The self-serve, communion containment, presentation and service device of claim 5, further comprising a second lengthwise row of through slots, the second lengthwise row located in front of the first lengthwise row.

7. The self-serve, communion containment, presentation and service device of claim 6, wherein the second lengthwise row is positioned below the first row.

8. The self-serve, communion containment, presentation and service device of claim 1, wherein the device is configured to receive a portion of another self-serve, communion containment, presentation and serving device such that the self-serve, communion containment, presentation and serving device is a stackable device.

9. A communion service kit that includes the self-serve, communion containment, presentation and service device of claim 1 and a plurality of communion cups.

10. A self-serve, communion containment, presentation and service device for containing, presenting and serving a plurality of edible communion items, comprising:

a frame; and a plurality of individual communion-containment units connected to the frame, each communion-containment unit configured to contain a single edible communion host, each of the plurality of individual communion-containment units includes:

a platform portion having a platform surface;

an opening in the platform portion, the opening configured to receive and position the edible communion item in a predetermined position; and a hinged cover moveable between a first position covering the opening and a second position exposing the opening, wherein the opening in the platform surface defines a slot and the platform surface also defines a communion cup aperture, wherein the slot is the only opening in the platform surface configured to receive an edible communion item, and the communion cup aperture is the only opening in the platform surface configured to receive a communion cup.

11. The self-serve, communion containment, presentation and service device of claim 10, wherein the opening in the platform surface defines a slot, and the slot is the only opening in the platform surface configured to receive an edible communion item.

12. The self-serve, communion containment, presentation and service device of claim 11, wherein the slot is defined in part by a slot wall formed in the platform portion, the slot wall forming a non-acute angle with the platform surface.

13. The self-serve, communion containment, presentation and service device of claim 10, wherein the platform portions of the plurality of individual communion-containment units form an integrated platform of the self-serve, communion containment, presentation and service device, and the platform surfaces of the plurality of individual communion-containment units form a continuous platform surface of the self-serve, communion containment, presentation and service device.

14. The self-serve, communion containment, presentation and service device of claim 10, wherein the hinged cover contacts the platform surface when in the first position.

15. The self-serve, communion containment, presentation and service device of claim 14, wherein the hinged cover does not contact the platform surface when in the second position, and is configured to stay in the second position without intervention from a user.

16. The self-serve, communion containment, presentation and service device of claim 10, wherein the plurality of individual communion-containment units are arranged linearly in a row.

17. The self-serve, communion containment, presentation and service device of claim 10, further comprising a bottom portion configured to contact the edible communion item when the edible communion item is received by the opening in the platform portion.

* * * * *